US007497684B1

(12) United States Patent
Storms

(10) Patent No.: US 7,497,684 B1
(45) Date of Patent: Mar. 3, 2009

(54) COMBINATION WICK CUTTER AND LIGHTER

(76) Inventor: Latina Storms, 812 Duvall Pl. NE., Renton, WA (US) 98059

( * ) Notice: Subject to any disclaimer, the term of this patent is extended or adjusted under 35 U.S.C. 154(b) by 0 days.

(21) Appl. No.: 11/972,167

(22) Filed: Jan. 10, 2008

(51) Int. Cl.
*F23Q 2/32* (2006.01)

(52) U.S. Cl. ..... 431/253; 431/120; 131/248; 131/249

(58) Field of Classification Search ..... 431/253, 431/120; 131/248, 249
See application file for complete search history.

(56) References Cited

U.S. PATENT DOCUMENTS 533,207 A * 1/1895 Campbell ..... 30/110
665,921 A * 1/1901 Miller ..... 431/132
711,171 A * 10/1902 Miller ..... 431/132
1,373,262 A * 3/1921 Racz ..... 221/79
1,502,974 A * 7/1924 Aronson ..... 131/233
1,674,314 A * 6/1928 Bettini ..... 431/137
4,946,383 A * 8/1990 Wu ..... 431/125
6,209,207 B1 * 4/2001 Patterson et al. ..... 30/125
6,619,950 B2 * 9/2003 Ricci ..... 431/253
6,655,031 B1 * 12/2003 Grant et al. ..... 30/125

* cited by examiner

*Primary Examiner*—Kenneth B Rinehart
*Assistant Examiner*—Jorge Pereiro
(74) *Attorney, Agent, or Firm*—David L. Tingey

(57) ABSTRACT

A combination wick cutter and lighter includes a tube connected to a handle with an opening in the end of the tube into which a wick may be received vertically along a tube longitudinal axis. When the wick is in the opening, the user moves an actuator to cut the wick and further moves the actuator to ignite the wick. Because the tube is advanced vertically, a candle wick in a candle holder with high sides relative to the position of the wick may be trimmed and lit.

14 Claims, 4 Drawing Sheets

COMBINATION WICK CUTTER AND LIGHTER

BACKGROUND

1. Field of the Invention

This invention relates to candle lighting and cutting or trimming. More particularly, the invention relates to a single device for cutting and for lighting the candle. Even more specifically, the invention to such a single device that can be used to reach and service candle wicks in a candle with candle container sides high above the candle and its wick.

2. Prior Art

Decorative candles are available in a large number of candle containers. It is known to have candle wick cutters. It is also known to have candle wick lighters. It is not common to have a candle wick cutter and a candle wick lighter in the same device. Though the art includes combination candle wick cutter and candle wick lighters, they require that the device be oblique to the candle. That is, the device must be oblique to the candle for the wick to be able to enter an opening where the wick can be cut. This limits use of the device to candles with their wicks close to the open top of the candle container where they can be reached by a device oblique to the candle.

When the candle burns down below the candle container sides, the candle wick is difficult to reach and the oblique devices are not applicable.

Therefore an object of the present invention is to provide a combination wick cutting and lighting device that are effective for candles below a candle relatively small container opening at its top, even in its limit to an opening only slightly larger than the transverse dimensions of the device and as deep as a tube extending from a device handle.

SUMMARY

This object is achieved by the combination wick cutter and lighter of the present invention comprising a tube connected to a handle with an opening in the end of a tube into which a wick may be received. In practice the combination wick cutter and lighter is advanced toward an upstanding wick vertically, that is, with the longitudinal axis of the tube aligned in parallel with the wick. When the wick is in the opening, the user moves the actuator to cut the wick and further moves the actuator to ignite the wick. Because the tube is advanced vertically, a candle wick in a candle holder with high sides relative to the position of the wick may be trimmed and lit. The open top of the candle holder may be only slightly larger than the diameter of the tube.

The trimming and lighting of the candle wick by action of an actuator at the handle which causes a blade to rotate across a cutter at the opening cutting the wick in a scissor affect as the actuator moves from a rest position to a second position. Fuel is released when the actuator is further moved from the second position to a third position. When the actuator reaches the third position, the actuator causes an igniter to ignite the fuel. Fuel release is stopped when the actuator returns to its second position.

DETAILED DESCRIPTION OF THE PREFERRED EMBODIMENTS

Figure 1:
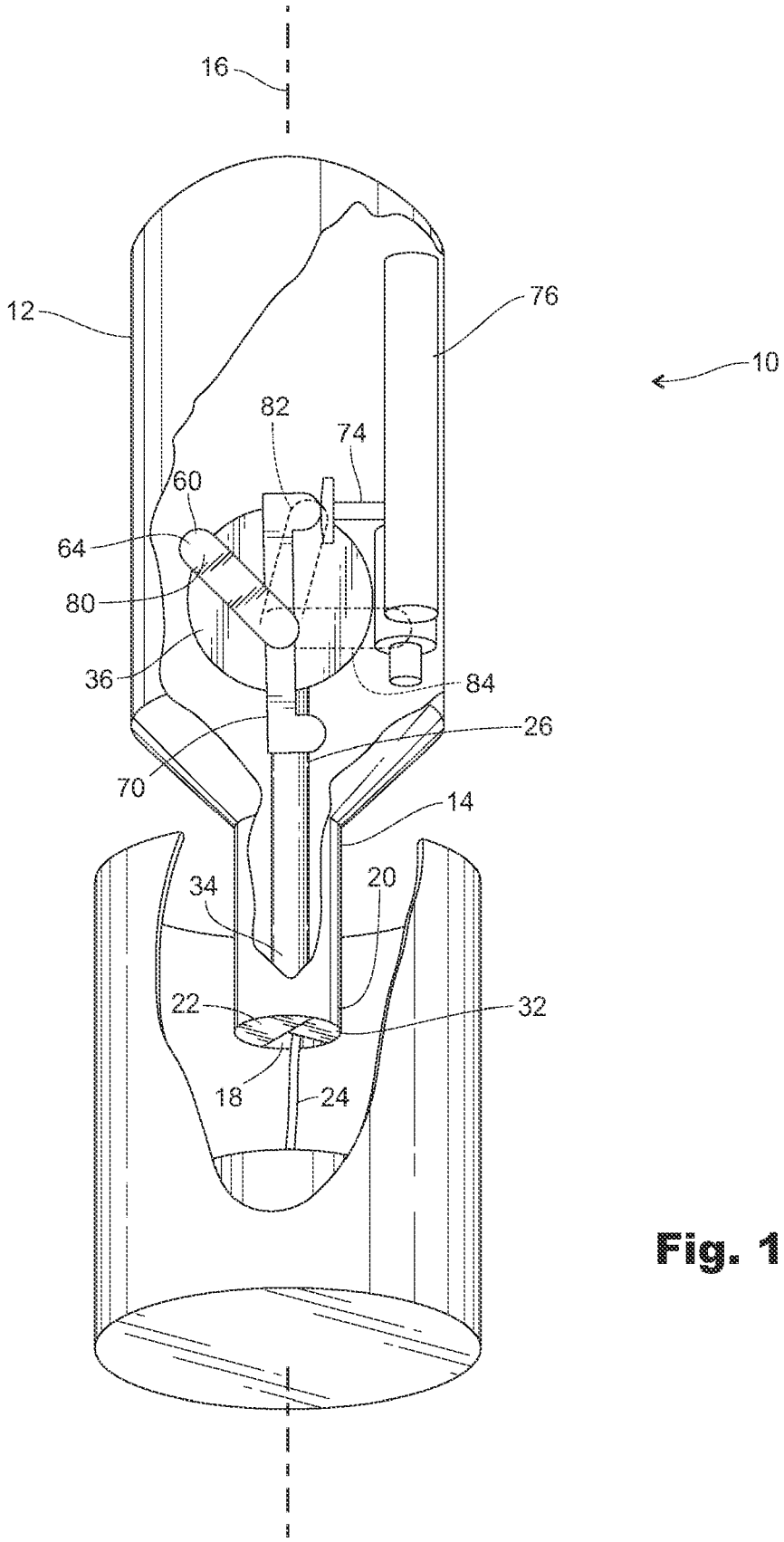
FIG. 1 is a cut-away perspective view of the combination wick cutter and lighter of the present invention.
Figure 2:
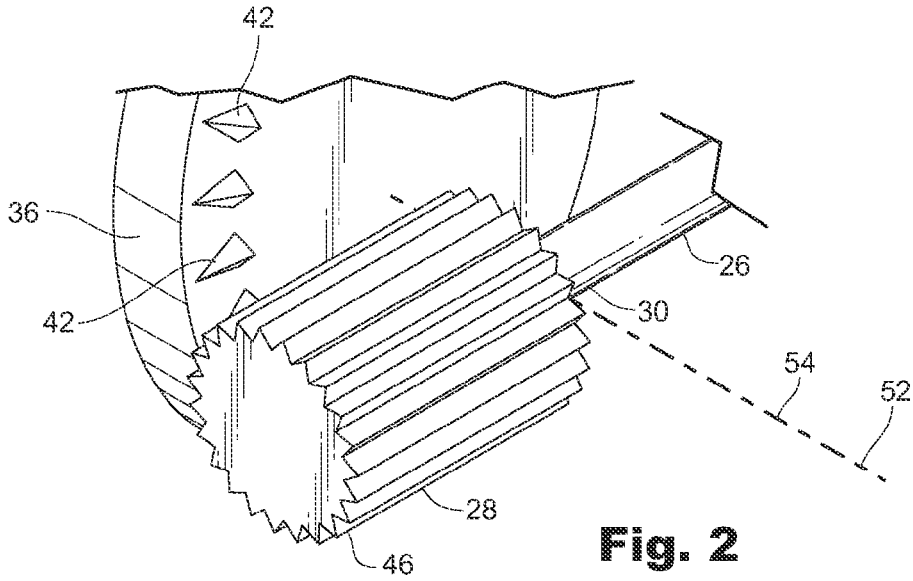
FIG. 2 is a perspective view of the gear and disk.
Figure 3:
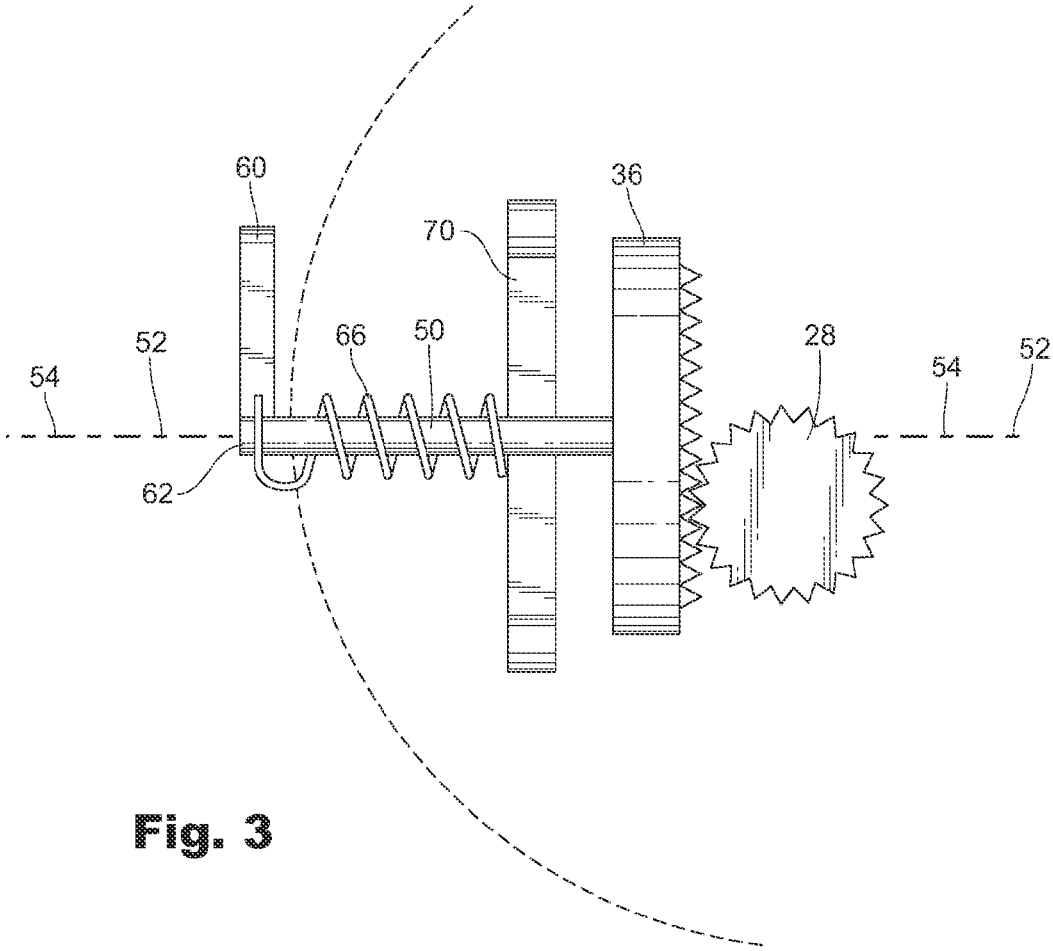
FIG. 3 is an end view of the gear and disk and first and second levers extending from the disk rod that is coaxial with the disk.
Figure 4:
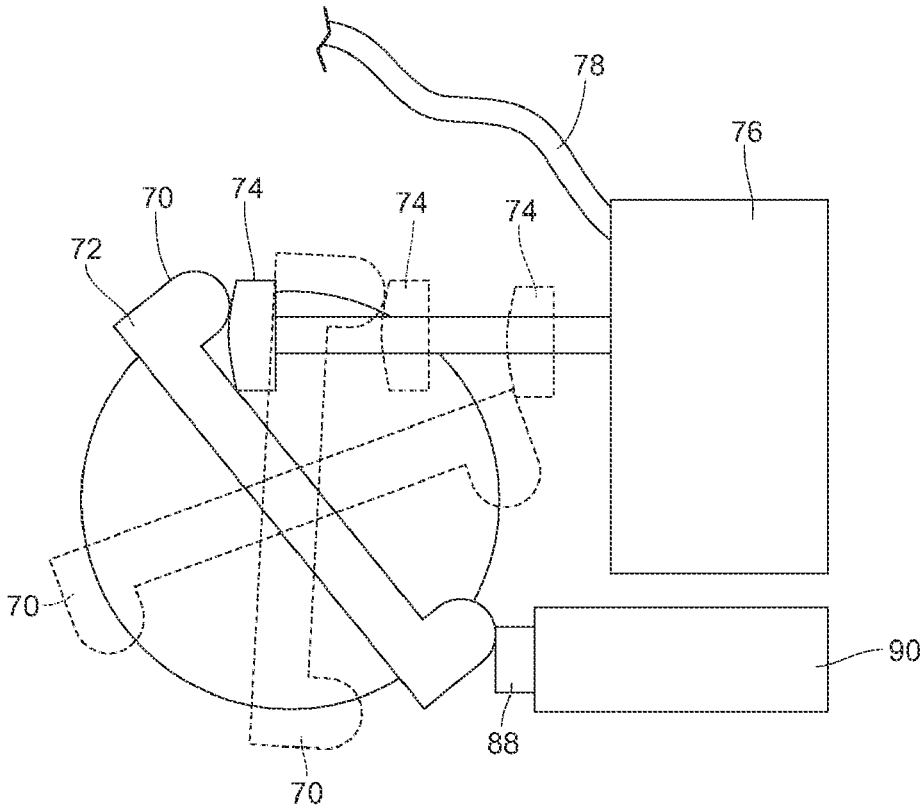
FIG. 4 is a front view of the second lever in a first position corresponding to the first position of the first lever, with second and third positions in phantom dotted lines corresponding to second and third positions of the first lever, the second lever shown in contact with an igniter switch on one lever end and a fuel valve on the other lever end.
Figure 5:
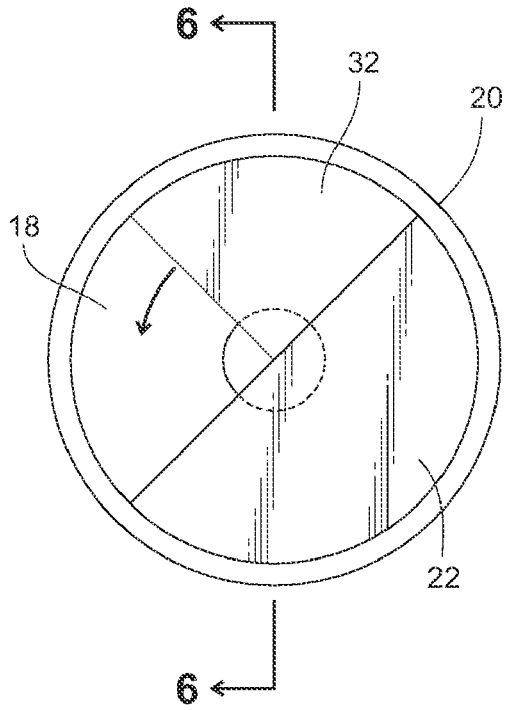
FIG. 5 is an end view of the tube showing the cutter, the blade and the tube opening all at the tube end.
Figure 6:
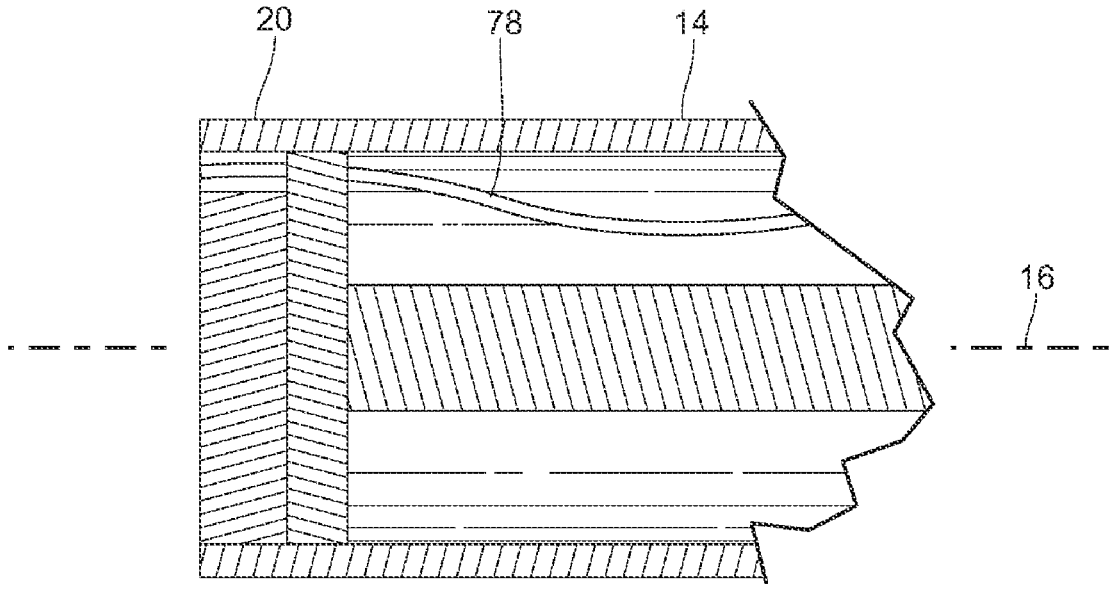
FIG. 6 is a cross-section view taken along the lines 6-6 of FIG. 5.
Figure 7:
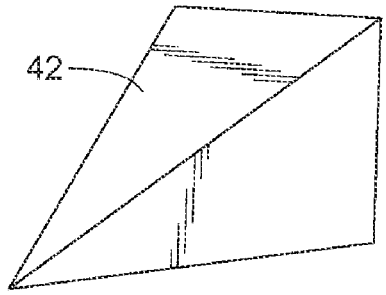
FIG. 7 is a perspective view of one of the teeth arranged on a circular arc on the face of the disk, angled as shown to interface with the gear, thus shaped so the teeth on the disk rotating on an axis perpendicular to that of the gear engages smoothly with the gear teeth, the high portion of the tooth first and then gradually the remainder of the tooth engaging the gear as the disk rotates and releasing from the gear similarly with the high portion releasing last.

This combination wick cutter and lighter 10 comprises a handle 12 that functions as the body of the wick cutter and lighter. A tube 14, with a longitudinal axis 16 and an opening 18 in a tube end 20, extends from the handle 12. A cutter 22 fixed in the tube 14 at the tube end 20 extends across the tube 14 transversely leaving the opening 18 in the tube end 20. With the tube 14 positioned with the axis 16 of the tube 14 parallel to an upstanding wick 24. Thus the wick 24 may be received into the opening 18 in the tube end 20 as the tube 14 is moved toward the wick 24 parallel to the tube axis 16.

A blade rod 26 within the tube 14 is parallel to the tube axis 16 and extends from a gear 28 on a blade rod first end 30 to a blade 32 on a blade rod second end 34 at the tube end 20. The blade 32 extends radially from the blade rod second end 34 across the tube end 20. When the blade rod 26 is rotated the blade 32 moves across the opening 18 in a scissor action with the cutter 22 thereby cutting the wick 24 in the tube opening 18.

A disk 36 in the handle 12 rotates on a disk axis 38 that is orthogonal to a rod axis 40. A plurality of disk teeth 42 is arranged on a disk face 44 to mesh with teeth 46 of gear 28 as the disk 36 rotates, thus causing the blade rod 26 to rotate as the disk 36 rotates. A disk rod 50 is secured to the disk 36 with its disk rod axis 52 coaxial with a disk axis 54. The disk rod 50 extends out of the handle 12 to a first lever 60 that extends radially from a disk rod end 62 out of the handle 12 as an actuator of the combination cutter and lighter 10 such that as the first lever 60 is moved the disk 36 rotates which thereby causes the blade rod 26 to rotate and the blade 32 to move across the cutter 22 in a scissor action. The first lever 60 moves away from its rest position 64 under spring bias and returns to its rest position 64 when released by action of a spring 66.

A second lever 70 also extends radially from the disk rod 50 but within the handle 12. A second lever first end 72 releasably engages a reservoir valve 74 controlling release of fuel from a fuel reservoir 76 such that as the second lever 72 rotates with the disk rod 40 the fuel reservoir valve 74 opens causing fuel to pass through a fuel line 78 that extends from the fuel reservoir 76 to the tube end 20. As the first lever 60 moves from a rest position 80 to a second position 82 the blade 32 moves across the tube end 20, cutting the wick 24. If a user only wishes to trim the wick 24, the first lever 60 is released to return to its rest position 80.

If the user wishes to also ignite the wick 24 after just trimming it, the first lever 60 is further moved under spring bias to a third position 84. As the first lever 60 moves past its second position 82 toward its third position 84, the reservoir valve 74 engaged with the second lever first end 72 opens. A second lever second end 86 engages an igniter switch 88 when the first lever 60 is at its third position 84 which activates an electric igniter 90 disposed to ignite fuel at the tube end 20. Thus, as the first lever 60 moves past its second position 82 to its third position 84, the second lever first end 72 opens the reservoir valve 74 and causes fuel to be released at the tube end 20 as the second lever second 86 actuates the electric igniter 90 thereby igniting the released fuel, which provides a flame that lights the wick 24 at the tube end 20. Fuel continues to flow through the fuel line 78 until the first lever 60 moves back to its second position 82 and then to the lever rest position 80. Simultaneously, as the first lever 60 moves away from its third position 84 the disk rod 50 rotates, withdrawing the blade 32 across the tube end 20 thereby restoring the opening 18 at the tube end 20.

It should be appreciated that though an actuator has been described for convenience of description simply as a first lever, any other mechanism, such as a trigger effecting a similar movement would achieve the same result. Similarly, two levers or triggers may be employed to give equivalent effect, one for comparable movement of the first lever between its rest position and its first position, the other for comparable movement of the first lever between its second and third positions. These and all other equivalent embodiments are deemed included in the described embodiment.

It should be further appreciated that for a wick cutter and lighter with a tube having a tube length extending from the handle, the combination wick cutter and lighter can cut and light a candle wick as deep in a candle container as the tube length with a container opening at its top only large enough to allow the tube to enter the container opening. For all purposes herein, the width of the cutter is deemed insignificant and subtracted in the description.

The cutting mechanism is described in terms of a scissoring action between two blades, one of them being fixed and described as a cutter only for ease of reference. It should be further appreciated that any of many cutting actions could be employed and that for all purposes herein including the following claims, this description is exemplary of those many cutting actions, all of which are deemed included in this description provided.

Having described the invention, what is claimed is:

1. A combination wick cutter and lighter comprising:

a handle that functions as the body of the combination wick cutter and lighter;

a tube, with a longitudinal axis and an opening in a tube end for receiving a wick, the tube extending from the handle;

a cutter fixed in the tube at the tube end extending across the tube transversely leaving the opening in the tube end;

wherein the wick may be received into the opening in the cutter end as the tube is moved toward the wick along the tube axis with the tube positioned with its axis parallel to an upstanding wick;

a blade rod within the tube parallel to and offset from the tube axis, the blade rod with blade rod first and second ends and a blade on the blade rod second end alongside the cutter at the tube end, the blade extending radially from the blade rod second end across the opening at the tube end, wherein the blade moves across the opening in a scissor action with the cutter when the blade rod is rotated thereby cutting the wick in the tube opening;

a fuel line between the tube end and a fuel reservoir;

an igniter that ignites fuel released from the fuel line at the tube end;

an actuator functionally connected to the blade rod such that as the actuator moves from a rest position to a second position the blade rod rotates moving the blade across the opening and as the actuator moves to a third position fuel is released from the fuel line and the igniter ignites the fuel when the actuator is at the third position, release of fuel stopping when the actuator moves away from its third position.

2. The combination of claim 1 further comprising a spring disposed such the actuator moves from its rest position against bias of the spring, the spring causing the actuator to return to its rest position when the actuator is released.

3. The combination of claim 1 further comprising a gear on the blade rod first end;

a disk rotating on a disk axis that is orthogonal to the rod axis, the disk including a plurality of disk teeth arranged on a disk face to mesh with teeth of the gear as the disk rotates therein causing the blade rod to rotate as the disk rotates.

4. The combination of claim 2 further comprising a disk rod secured coaxially to the disk, the disk rod extending out of the handle and mechanically connected to the actuator such that movement of the actuator causing the disk rod to rotate.

5. The combination of claim 4 wherein the actuator comprises a first lever extending radially from the disk rod end outside the handle such that as the first lever is moved the disk rotates.

6. The combination of claim 4 where the actuator comprises a trigger mechanically connected to effect rotation of the disk rod between a rest position and second and third positions as the trigger is pulled.

7. The combination of claim 4 further comprising a reservoir valve controlling release of fuel from the fuel reservoir;

a second lever extending from the disk rod wherein as the second lever rotates as the actuator moves from its second position to its third position the fuel reservoir valve opens causing fuel to pass through the fuel line.

8. The combination of claim 7 wherein the second lever engages an igniter switch when the actuator moves to its third position, the igniter switch actuating an electric igniter disposed to ignite fuel at the tube end.

9. A combination wick cutter and lighter comprising:

a handle that functions as the body of the combination wick cutter and lighter;

a tube, with a longitudinal axis and an opening in a tube end for receiving a wick, the tube extending from the handle;

a cutter fixed in the tube at the tube end extending across the tube transversely leaving the opening in the tube end, wherein the wick may be received into the opening in the cutter end as the tube is moved toward the wick parallel to the tube axis with the tube positioned with its axis parallel to an upstanding wick;

a blade rod within the tube parallel to and offset from the tube axis, the blade rod having blade rod first and second ends;

a blade on the blade rod second end, the blade extending radially from the blade rod second end across the tube end opening alongside the cutter, wherein the blade moves across the opening in a scissor action with the cutter when the blade rod is rotated thereby cutting the wick in the tube opening;

a gear on the blade rod first end;

a disk rotating on a disk axis that is orthogonal to the rod axis, the disk including a plurality of disk teeth arranged on a disk face to mesh with teeth of the gear as the disk rotates therein causing the blade rod to rotate as the disk rotates;

a disk rod secured coaxially to the disk, the disk rod extending out of the handle and mechanically connected to the actuator such that movement of the actuator causing the disk rod to rotate;

a fuel line between the tube end and a fuel reservoir;

an igniter that ignites fuel released from the fuel line at the tube end;

a first lever extending radially from the disk rod outside the handle such that as the first lever is moved the disk rotates and as the first lever moves from a rest position to a second position the blade rod rotates moving the blade across the opening and as the first lever moves to a third position fuel is released from the reservoir and the igniter ignites the fuel, release of fuel stopping when the actuator moves back to its second position.

10. The combination of claim 9 further comprising a second lever extending from the disk rod with second lever first and second ends;

a reservoir valve controlling release of fuel from the fuel reservoir;

the second lever first end releasably engaging the reservoir valve such that as the disk rod rotates the fuel reservoir valve opens causing fuel to pass through the fuel line.

11. The combination of claim 9 further comprising a spring disposed such the first lever moves from its rest position against bias of the spring, the spring causes the first lever to return to its rest position when the first lever is released.

12. The combination of claim 10 wherein the second lever second end contacts an igniter switch when the first lever moves to its third position actuating an electric igniter disposed to ignite fuel at the tube end.

13. A combination wick cutter and lighter comprising:

a handle that functions as the body of the combination wick cutter and lighter;

a tube, with a longitudinal axis and an opening in a tube end for receiving a wick, extending from the handle;

a cutter fixed in the tube at the tube end extending across the tube transversely leaving the opening in the tube end;

wherein the wick may be received into the opening in the cutter end as the tube is moved toward the wick along the tube axis with the tube positioned with its axis parallel to an upstanding wick;

a blade rod within the tube parallel to and offset from the tube axis, the blade rod with blade rod first and second ends and a blade on the blade rod second end alongside the cutter at the tube end, the blade extending radially from the blade rod second end across the opening at the tube end, wherein the blade moves across the opening in a scissor action with the cutter when the blade rod is rotated thereby cutting the wick in the tube opening;

a gear on the blade rod first end;

a disk rotating on a disk axis that is orthogonal to the rod axis, the disk including a plurality of disk teeth arranged on a disk face to mesh with teeth of the gear as the disk rotates therein causing the blade rod to rotate as the disk rotates;

a disk rod secured coaxially to the disk, the disk rod extending out of the handle and mechanically connected to the actuator such that movement of the actuator causing the disk rod to rotate;

a fuel line between the tube end and a fuel reservoir;

an igniter that ignites fuel released from the fuel line at the tube end;

a first lever extending radially from the disk rod end outside the handle such that as the first lever is moved the disk rotates such that as the first lever moves from a rest position to a second position the blade rod rotates moving the blade across the opening and as the first lever moves to a third position fuel is released from the fuel line and the igniter ignites the fuel when the first lever is at its third position, release of fuel stopping when the actuator moves back to its second;

a second lever extending from the disk rod with second lever first and second ends;

a reservoir valve controlling release of fuel from the fuel reservoir;

the second lever first end releasably engaging the reservoir valve such that as the disk rod rotates the fuel reservoir valve opens causing fuel to pass through the fuel line;

a spring disposed such the first lever moves from its rest position against bias of the spring, the spring causes the first lever to return to its rest position when the first lever is released;

wherein the second lever second end contacts an igniter switch when the first lever moves to its third position actuating an electric igniter disposed to ignite fuel at the tube end, which provides a flame that lights the wick at the tube end, fuel continuing to flow until the first lever moves back to the second position closing the reservoir valve.

14. A combination wick cutter and lighter of claim 13 wherein the combination wick cutter and lighter comprises said tube with a tube length from the handle such that with a tube of said tube length the combination wick cutter and lighter can cut and light a candle wick as deep in a candle container as the tube length with a container opening at its top only large enough to allow the tube to enter the container opening.

* * * * *